US010734734B2

(12) United States Patent
Yoshitake

(10) Patent No.: US 10,734,734 B2
(45) Date of Patent: Aug. 4, 2020

(54) ANTENNA DEVICE AND RADIO-WAVE RADIATING METHOD

(71) Applicant: DENSO TEN Limited, Kobe-shi, Hyogo (JP)

(72) Inventor: Hiroaki Yoshitake, Kobe (JP)

(73) Assignee: DENSO TEN Limited, Kobe (JP)

( * ) Notice: Subject to any disclaimer, the term of this patent is extended or adjusted under 35 U.S.C. 154(b) by 160 days.

(21) Appl. No.: 16/028,616

(22) Filed: Jul. 6, 2018

(65) Prior Publication Data

US 2019/0067832 A1 Feb. 28, 2019

(30) Foreign Application Priority Data

Aug. 28, 2017 (JP) ..... 2017-163781

(51) Int. Cl.

| | |
|---|---|
| ***H01Q 21/00*** | (2006.01) |
| ***H01Q 21/08*** | (2006.01) |
| ***H01Q 13/20*** | (2006.01) |
| ***H01Q 9/30*** | (2006.01) |
| *H01Q 9/04* | (2006.01) |

(52) U.S. Cl.

CPC ..... *H01Q 21/0075* (2013.01); *H01Q 9/30* (2013.01); *H01Q 13/203* (2013.01); *H01Q 21/08* (2013.01); *H01Q 9/0407* (2013.01)

(58) Field of Classification Search

CPC .... H01Q 21/0075; H01Q 9/30; H01Q 13/085; H01Q 13/203; H01Q 21/08; H01Q 9/0407

See application file for complete search history.

(56) References Cited

U.S. PATENT DOCUMENTS

2010/0283687 A1* 11/2010 Ehelen ..... H01Q 21/0087 343/700 MS
2016/0079674 A1* 3/2016 Okunaga ..... H01Q 1/38 343/737
2018/0267139 A1* 9/2018 Park ..... H01Q 21/08
2019/0074599 A1* 3/2019 Yu ..... H01Q 21/065

FOREIGN PATENT DOCUMENTS

JP 2016-086432 A 5/2016

* cited by examiner

*Primary Examiner* — Dameon E Levi
*Assistant Examiner* — David E Lotter
(74) *Attorney, Agent, or Firm* — Oliff PLC

(57) ABSTRACT

An antenna device according to an embodiment includes a main line, radiating elements, and feed lines. The radiating elements are arranged along the main line and radiate radio waves. The feed lines connect the main line and the respective radiating elements. Moreover, the feed lines are inserted into the respective radiating elements by inserted lengths so that an electrical coupling degree between one of the feed lines and corresponding one of the radiating elements is larger as the one feed line is located closer to a leading end than a base end of the main line.

5 Claims, 7 Drawing Sheets

ANTENNA DEVICE AND RADIO-WAVE RADIATING METHOD

CROSS-REFERENCE TO RELATED APPLICATION

This application is based upon and claims the benefit of priority of the prior Japanese Patent Application No. 2017-163781, filed on Aug. 28, 2017, the entire contents of which are incorporated herein by reference.

FIELD

The embodiment discussed herein is directed to an antenna device and a radio-wave radiating method.

BACKGROUND

Conventionally, there has been known an antenna device that is formed on a board as a surface pattern, such as a microstrip antenna. The antenna device includes, for example: radiating elements that radiate radio waves; and a main line that supplies electric power, which is supplied from a controller of a radar apparatus etc., to the radiating elements (see, e.g., Japanese Laid-open Patent Publication No. 2016-086432).

In such an antenna device, for example, shapes and/or element widths of the radiating elements are changed for each of the radiating elements so as to adjust a distribution ratio of electric-power to be supplied to the radiating elements, and thus the directivity of radio waves is designed to be low side lobe.

However, when matching elements are used for the radiating elements in order to realize a desired electric-power distribution ratio, for example, an impedance adjusting circuit is to be additionally provided to each of the elements, and thus the configuration becomes complicated. Moreover, when the element widths of the radiating elements are changed, there exists possibility that the robustness is reduced due to effects of manufacturing tolerance. As described above, conventionally, there exists possibility that an antenna shape becomes complicated in order to achieve the desired electric-power distribution ratio.

SUMMARY

An antenna device according to an embodiment includes a main line, radiating elements, and feed lines. The radiating elements are arranged along the main line and radiate radio waves. The feed lines connect the main line and the respective radiating elements. Moreover, the feed lines are inserted into the respective radiating elements by inserted lengths so that an electrical coupling degree between one of the feed lines and corresponding one of the radiating elements is larger as the one feed line is located closer to a leading end than a base end of the main line.

BRIEF DESCRIPTION OF DRAWINGS

A more complete appreciation of the disclosed technology and many of the attendant advantages thereof will be readily obtained as the same becomes better understood by reference to the following detailed description when considered in connection with the accompanying drawings, wherein.

DESCRIPTION OF EMBODIMENTS

Hereinafter, an antenna device and a radio-wave radiating method disclosed in the present application will be described in detail with reference to the accompanying drawings. Moreover, the embodiment described below is merely one example, and not intended to limit the present disclosure.

Figure 1:
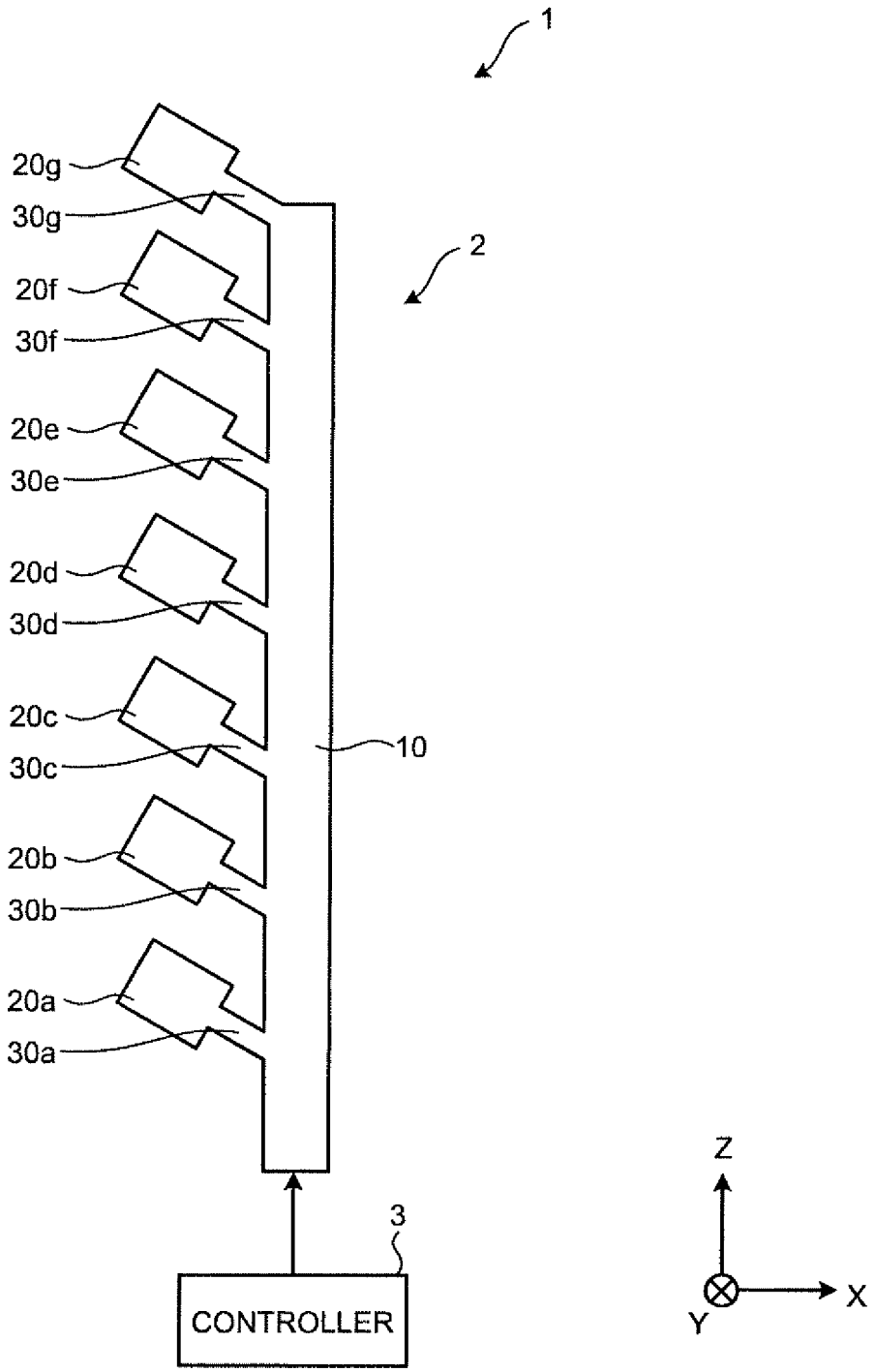
FIG. 1 is a diagram illustrating a radar apparatus according to an embodiment.

First, a radar apparatus in which antenna device according to an embodiment is provided will be explained with reference to FIG. 1. FIG. 1 is a diagram illustrating a radar apparatus 1 according to the embodiment. The radar apparatus 1 is an apparatus that radiates radio waves having, for example, a Frequency Modulated Continuous Wave type (FM-CW type), a Fast-Chirp Modulation type (FCM type), or the like.

As illustrated in FIG. 1, the radar apparatus 1 according to the embodiment includes an antenna device 2 and a controller 3. The controller 3 transmits a frequency-modulated signal to the antenna device 2, for example. The antenna device 2 is an antenna device for transmitting that radiates the signal transmitted from the controller 3.

Furthermore, the radar apparatus 1 further includes an antenna device (not illustrated) for receiving in addition to the antenna device 2 for transmitting. Moreover, in FIG. 1, the number of the antenna devices 2 is one; however, the number of the antenna devices 2 provided in the radar apparatus 1 may be equal to or more than two.

As illustrated in FIG. 1, the antenna device 2 according to the embodiment includes: a main line 10, a plurality of radiating elements 20*a* to 20*f*; and a plurality of feed lines 30*a* to 30*f* so as to perform the radio-wave radiating method according to the embodiment. Furthermore, hereinafter, the plurality of radiating elements 20*a* to 20*f* may be referred to as "radiating elements 20", and the plurality of feed lines 30*a* to 30*f* may be referred to as "feed lines 30".

The main line 10 is a line through which electric power supplied from the controller 3 flows at a predetermined wavelength from a base end (negative side of Z-axis) toward a leading end (positive side of Z-axis). Hereinafter, the wavelength of the electric power in the main line 10, namely, a guide wavelength may be referred to as "λg".

The radiating elements 20 resonate with electric power supplied from the main line 10 and are in a resonant state so as to radiate radio waves toward the outside. The radiating elements 20 as well as the feed lines 30 are arranged to be tilted from the main line 10 by an angle of 45 degrees. The feed lines 30 are inserted into the respective radiating elements 20 so as to connect the main line 10 and the radiating elements 20. Specifically, the feed lines 30 are arranged at intervals of "λg" that is a guide wavelength of the main line 10.

In the radio-wave radiating method according to the embodiment, the feed lines 30 of the antenna device 2 are inserted into the respective radiating elements 20 by inserted lengths so that an electrical coupling degree between one of the feed lines 30 and corresponding one of the radiating elements 20 is larger as the one feed line 30 is located closer to the leading end (positive side of Z-axis) than the base end (negative side of Z-axis) of the main line 10.

The coupling degree is a value indicating what rate of electric power flows, from the electric power flowing in the main line 10, into the feed line 30. In other words, when input electric power in the main line 10 is constant, the electric power flowing from the main line 10 to the feed line 30 is larger as the coupling degree is larger.

Here, a conventional antenna device will be explained. Conventionally, an antenna device has been desirably designed so that the directivity of a radiated radio wave has a lower side lobe. Thus, in the conventional antenna device, in order to realize the low side lobe, it was preferable that, when the electric power flowing in the main line was defined as 100%, the radiant power was the highest at a center radiating element (in FIG. 1, radiating element 20*d*) and the radiant power was smaller as a position of a radiating element was closer to any of ends (base end and leading end). The magnitude of the radiant power was able to be changed by changing the distribution ratio of the electric power flowing in the main line.

Moreover, electric-power amount of the electric power flowing in the main line was smaller as a position was closer to the leading end, and thus the coupling degree was to be increased as the position is closer to the leading end. In the conventional antenna device, shapes of the radiating elements, element widths of the radiating elements, and feed-line lengths among other things were changed to achieve a desired electric-power distribution ratio.

When matching elements are used for the radiating elements, for example, impedance adjusting circuits are to be additionally provided to the respective elements, and thus the configuration becomes complicated. Moreover, when element widths of the radiating elements are changed, the manufacturing tolerance is inclined to increase, and thus there exists possibility that the robustness is reduced as a result. As described above, conventionally, there existed possibility that an antenna shape became complicated in order to achieve a desired electric-power distribution ratio.

Thus, in the antenna device 2 according to the embodiment, the inserted lengths of the feed lines 30 into the respective radiating elements 20 are adjusted to more increase a coupling degree as a position is closer to the leading end of the main line 10. In other words, only adjusting the inserted lengths is sufficient, and thus it is possible to achieve a desired electric-power distribution ratio along with a simple antenna shape without changing shapes of the radiating elements 20 and the feed lines 30. Here, the antenna device 2 according to the embodiment will be specifically explained with reference to FIG. 2.

Figure 2:
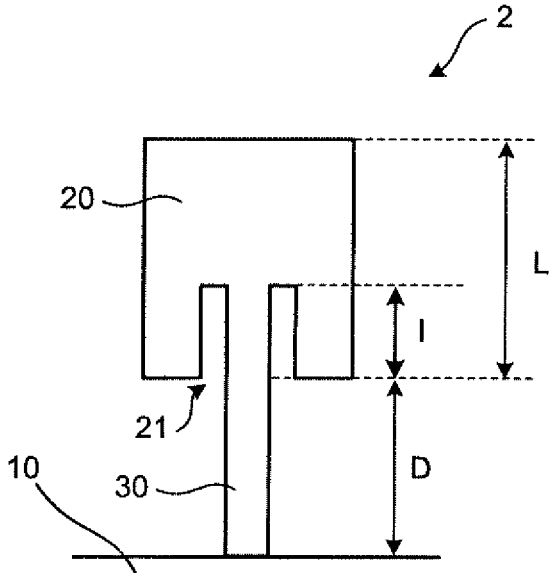
FIG. 2 is a diagram illustrating an antenna device according to the embodiment.

FIG. 2 is a diagram illustrating the antenna device 2 according to the embodiment. As illustrated in FIG. 2, the feed line 30 is inserted into the radiating element 20 so as to form a slit 21 of the antenna device 2. A length of the slit 21 corresponds to an inserted length I. Moreover, in FIG. 2, an element length L and a feed-line length D of the radiating element 20 are further depicted.

The element length L of the radiating element 20 is set to be "λg/2", which is half of the guide wavelength of the main line 10, in order to turn the radiating element 20 into a resonant state, for example. Moreover, the feed-line length D is set to be any one of "¼λg×(2n+1)" and "¼λg×(2n)" ("¼λg" is one fourth of guide wavelength and "n" is integer).

Specifically, in the feed line 30, there presents a standing wave of the electric power supplied from the main line 10. In a distribution of this standing wave, the voltage is the maximum value at "0λg", and subsequently and alternately becomes the maximum and minimum values at intervals of "¼λg".

In other words, the voltage in the standing wave is the minimum value when the feed-line length D is "¼λg×(2n+1)", and the voltage in the standing wave is the maximum value when the feed-line length D is "¼λg×(2n)". The voltage is a voltage that occurs in a connector between the main line 10 and the feed line 30.

Thus, a method for setting the inserted length I is changed depending on whether the feed-line length D is "¼λg×(2n+1)" or the feed-line length D is "¼λg×(2n)". The setting method of the inserted length I will be specifically explained with reference to FIGS. 3 to 5.

First, a setting method of the inserted length I when the feed-line length D is "¼λg×(2n+1)" will be explained with reference to FIGS. 3 to 5, and a setting method of the inserted length I when the feed-line length D is "¼λg×(2n)" will be subsequently explained with reference to FIGS. 6 to 8.

Figure 3:
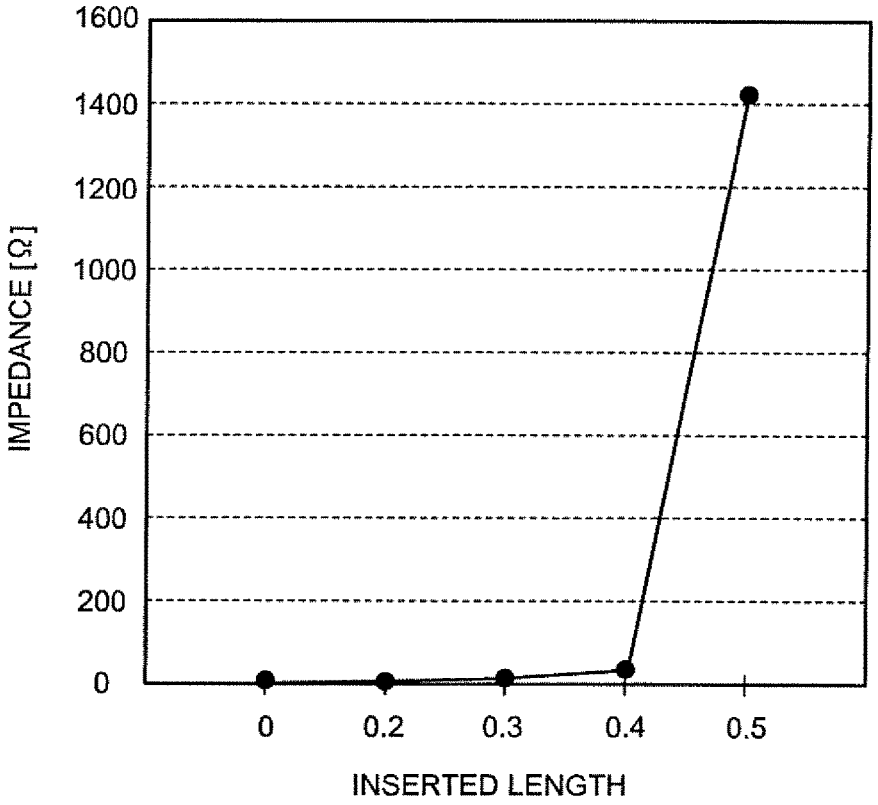
FIG. 3 is a diagram illustrating relationship between inserted length and impedance.

FIG. 3 is a diagram illustrating relationship between the inserted length I and the impedance. In a graph depicted in FIG. 3, the lateral axis indicates the inserted length I and the vertical axis indicates the impedance. Furthermore, each numeric value on the lateral axis indicates a ratio of the inserted length I to the element length L.

In other words, when the inserted length I is "0.2", the length of the inserted length I is 20% of the element length L. Moreover, the impedance mentioned here indicates input impedance on the radiating elements 20 side viewed from a connection point of the main line 10 and the feed line 30 (see FIG. 2).

As illustrated in FIG. 3, when the feed-line length D is "¼λg×(2n+1)", the impedance is larger as the inserted length I is longer. To be more specific, within a range of the ratio of the inserted length I from "0" to "0.4", the impedance transitions between "0Ω" to "50Ω", on the other hand, when the ratio is "0.5", the impedance rapidly increase to approximately "1400Ω".

In other words, when the feed-line length D is "¼λg×(2n+1)", electric power easily flows from the main line 10 to the radiating element 20 within the range of the inserted length I from "0" to "0.4", on the other hand, when the inserted length I is "0.5", the electric power does not easily flow from the main line 10 to the radiating element 20. In other words, the coupling degree reduces more as the inserted length I is longer.

Furthermore, although not illustrated in the graph depicted in FIG. 3, when the ratio of the inserted length I is equal to or more than "0.5", the impedance reduces again. In other words, in a case where the feed-line length D is "¼λg×(2n+1)", when the ratio of the inserted length I is approximately "0.5", the impedance becomes the highest, in other words, the coupling degree becomes the lowest.

Figure 4:
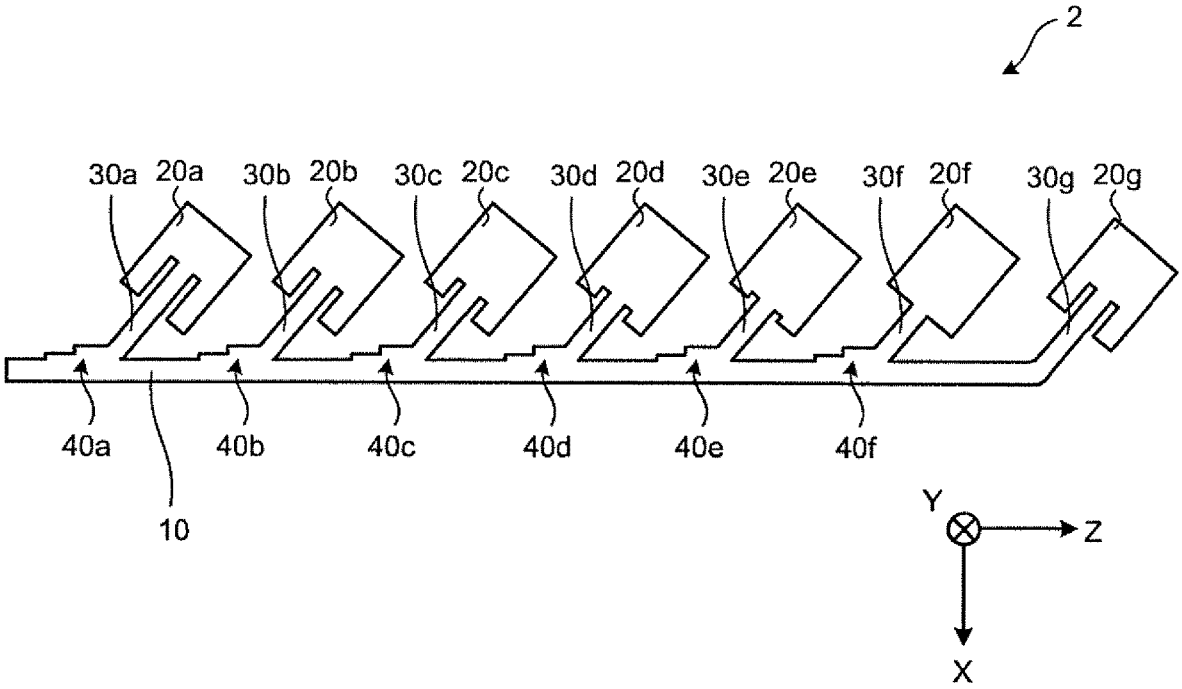
FIG. 4 is a diagram illustrating an arrangement example of antenna device according to the embodiment.
Figure 5:
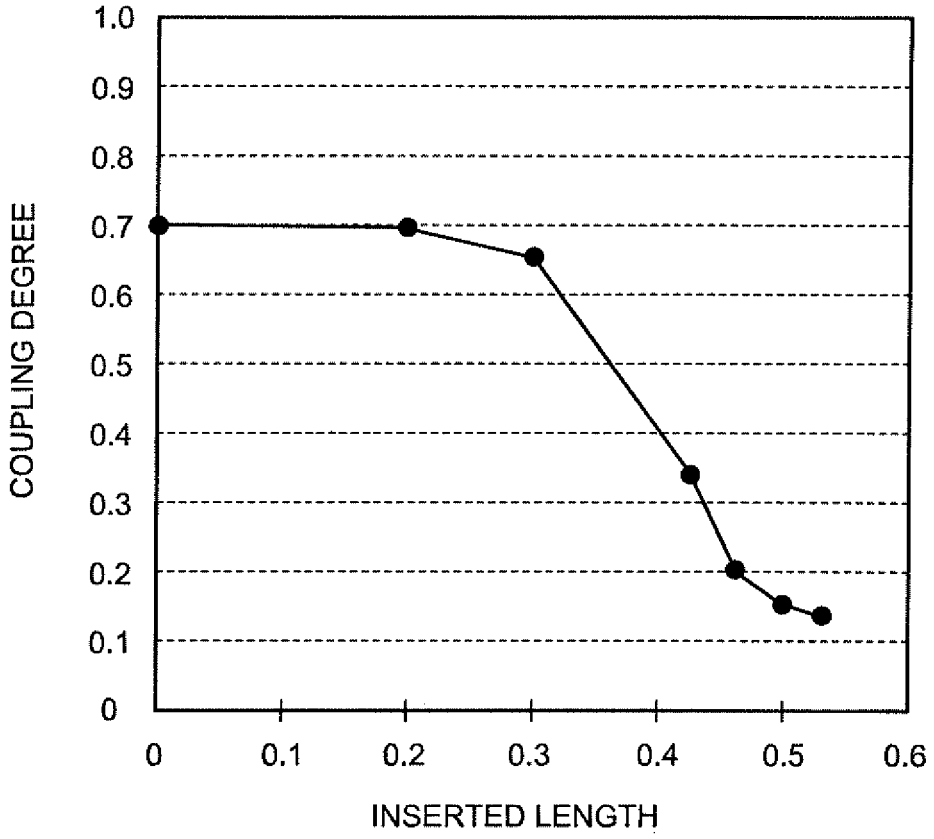
FIG. 5 is a diagram illustrating relationship between the inserted length and coupling degree.

An arrangement example of the radiating elements 20 using such impedance characteristics is illustrated in FIG. 4. FIG. 4 is a diagram illustrating the arrangement example of the antenna device 2 according to the embodiment. In FIG. 4, a case is exemplified in which the seven radiating elements 20*a* to 20*g* are individually connected to the main line 10. Moreover, assume that the feed-line length D is "¼λg×(2n+1)".

As illustrated in FIG. 4, the inserted lengths I of the six radiating elements 20*a* to 20*f* obtained by excepting the leading-end radiating element 20*g* from the seven radiating elements 20*a* to 20*g* are set so as to be gradually shorter as the radiating element 20 is located closer to the leading-end radiating element 20*f* than the base-end radiating element 20*a*. In other words, the coupling degree is gradually larger as the radiating element 20 is located closer to the leading-end radiating element 20*f* than the base-end radiating element 20*a*. Furthermore, a matching element whose coupling degree is "100%" is arranged at the radiating element 20*g* disposed on the leading end.

Moreover, as illustrated in FIG. 4, matching circuits 40*a* to 40*f* are disposed at the respective connection parts of the main line 10 and the feed lines 30*a* to 30*f*. Each of the matching circuits 40*a* to 40*f* is a circuit for matching with respect to the impedance for the inserted length I of corresponding one of the radiating elements 20*a* to 20*f*, and the performance according to this impedance is set.

Next, a simulation result indicating relationship between the inserted length I and the coupling degree when the feed-line length D is "¼λg×(2n+1)" will be explained with reference to FIG. 5. FIG. 5 is a diagram illustrating relationship between the inserted length I and the coupling degree. As illustrated in FIG. 5, within a range of the inserted length I from "0" to approximately "0.5", the maximum value of the coupling degree was approximately "0.7 (70%)", and the minimum value of the coupling degree was approximately "0.15 (15%)". In other words, the coupling degree was able to be adjusted within a range from "15%" to "70%" by adjusting the inserted length I.

In other words, the coupling degree is able to be adjusted without changing shapes of the radiating elements 20 and the feed lines 30, and thus it is possible to achieve a desired electric-power distribution ratio along with a simple antenna shape. Moreover, when the ratio of the inserted length I to the element length L is set to be equal to or less than "50%", it is possible to easily adjust the coupling degree.

Next, a method for setting the inserted length I when the feed-line length D is "¼λg×(2n)" will be explained with reference to FIGS. 6 to 8.

Figure 6:
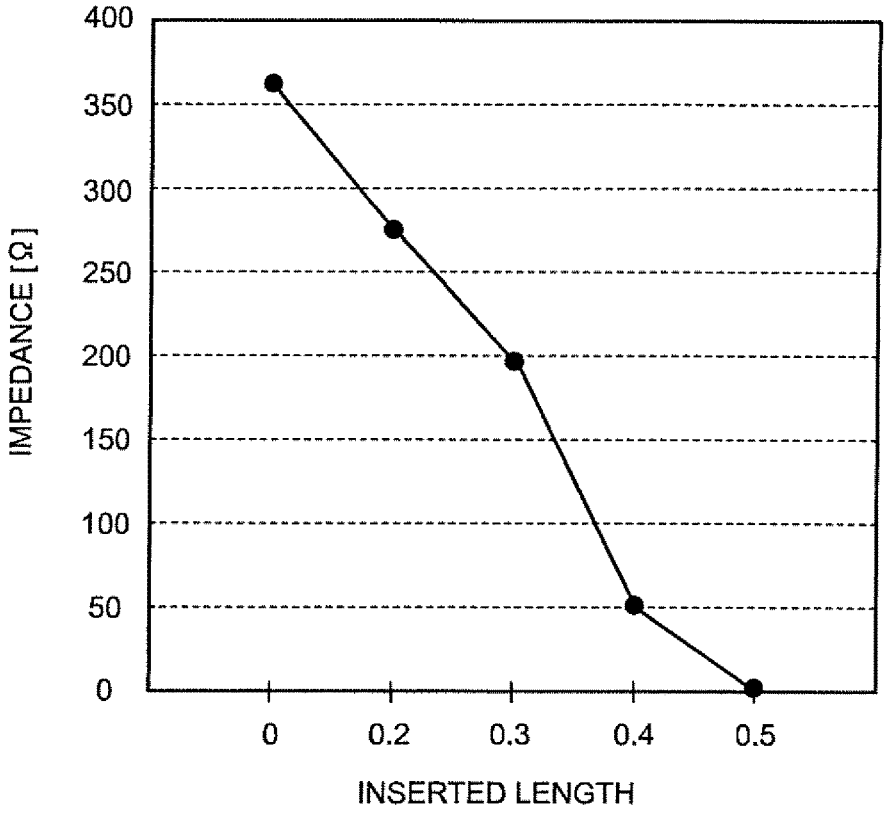
FIG. 6 is a diagram illustrating relationship between the inserted length and impedance.

FIG. 6 is a diagram illustrating relationship between the inserted length I and the impedance. In a graph depicted in FIG. 6, the lateral axis indicates the inserted length I, and the vertical axis indicates the impedance. Furthermore, the definition of the inserted length I indicated by the lateral axis and the impedance are similar to that depicted in FIG. 3, and thus the description thereof is omitted.

As illustrated in FIG. 6, when the feed-line length D is "¼λg×(2n)", the impedance is smaller as the inserted length I is longer. To be more specific, the impedance transitions between "0Ω" to "370Ω" within a range of the ratio of the inserted length I from "0" to "0.5". In other words, when the feed-line length D is "¼λg×(2n)", the coupling degree increases more as the inserted length I is longer, and thus the electric power easily flows to the radiating element 20.

Furthermore, although not illustrated in the graph depicted in FIG. 6, when the ratio of the inserted length I is equal to or more than "0.5", the impedance increases again. In other words, in a case where the feed-line length D is "¼λg×(2n)", when the ratio of the inserted length I is approximately "0.5", the impedance becomes the lowest, in other words, the coupling degree becomes the highest.

Figure 7:
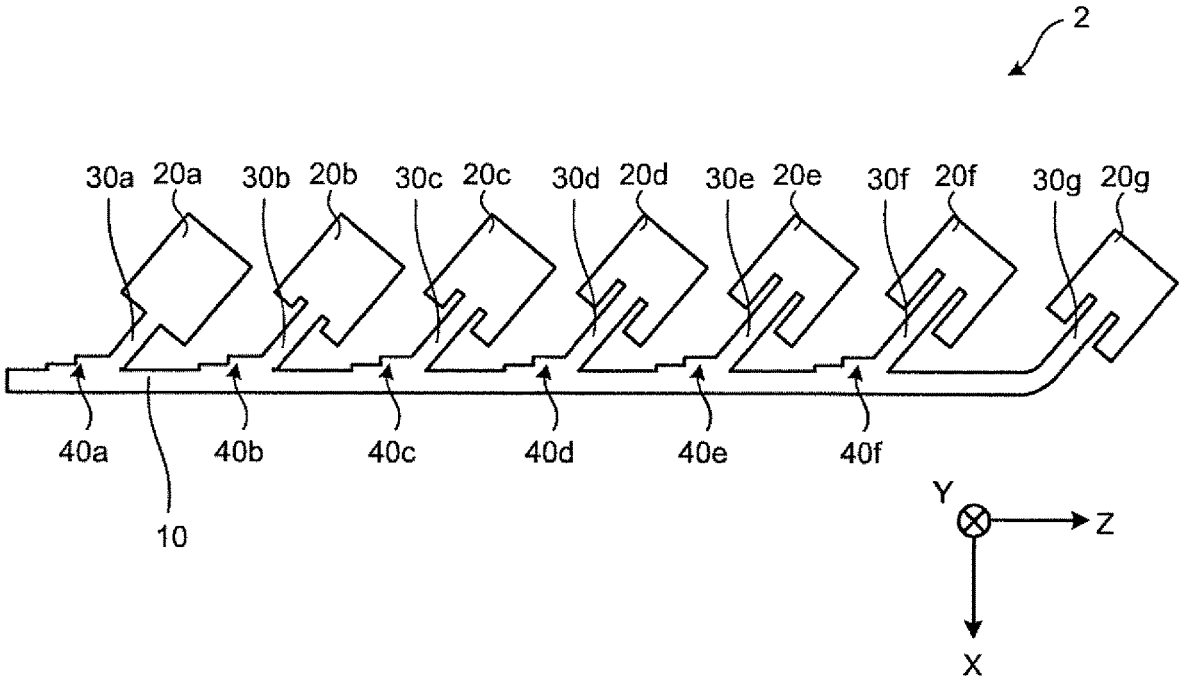
FIG. 7 is a diagram illustrating an arrangement example of the antenna device according to the embodiment.
Figure 8:
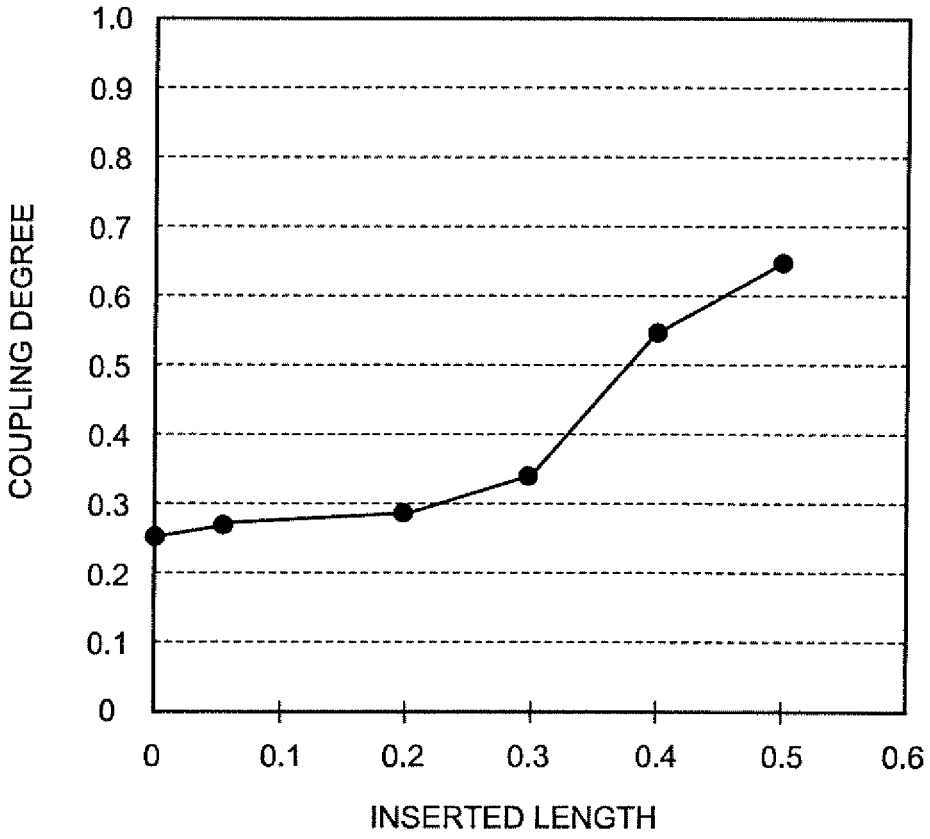
FIG. 8 is a diagram illustrating relationship between the inserted length and coupling degree.

An arrangement example of the radiating elements 20 using such impedance characteristics is illustrated in FIG. 7. FIG. 7 is a diagram illustrating an arrangement example of the antenna device 2 according to the embodiment. In FIG. 7, a case is exemplified in which the seven radiating elements 20*a* to 20*g* are individually connected to the main line 10. Moreover, assume that the feed-line length D is "¼λg×(2n)".

As illustrated in FIG. 7, the inserted lengths I of the six radiating elements 20*a* to 20*f* obtained by excepting the leading-end radiating element 20*g* from the seven radiating elements 20*a* to 20*g* are set so as to be gradually longer as the radiating element 20 is located closer to the leading-end radiating element 20*f* than the base-end radiating element 20*a*. In other words, the coupling degree is gradually smaller as the radiating element 20 is located closer to the leading-end radiating element 20*f* than the base-end radiating element 20*a*. Furthermore, a matching element whose coupling degree is "100%" is arranged at the radiating element 20*g* disposed on the leading end.

Moreover, as illustrated in FIG. 7, matching circuits 40*a* to 40*f*, which have performances according to the respective impedances, are disposed at the respective connection parts of the main line 10 and the feed lines 30*a* to 30*f*.

Next, a simulation result indicating relationship between the inserted length I and the coupling degree when the feed-line length D is "¼λg×(2n)" will be explained with reference to FIG. 8. FIG. 8 is a diagram illustrating relationship between the inserted length I and the coupling degree. As illustrated in FIG. 8, within a range of the inserted length I from "0" to "0.5", the maximum value of the coupling degree was approximately "0.65 (65%)", and the minimum value of the coupling degree was approximately "0.25 (25%)". In other words, the coupling degree was able to be adjusted within a range from "25%" to "65%" by adjusting the inserted length I.

In other words, the coupling degree is able to be adjusted without changing shapes of the radiating elements 20 and the feed lines 30, and thus it is possible to achieve a desired electric-power distribution ratio along with a simple antenna shape.

Moreover, in both case where the feed-line length D is "¼λg×(2n+1)" and the feed-line length D is "¼λg×(2n)", adjusting the inserted length I within a range equal to or less than "50%" of the element length L is able to reduce variation of the inserted length I, so that it is possible to avoid complexity in manufacturing processes.

As described above, the antenna device 2 according to the embodiment includes: the main line 10; the radiating elements 20; and the feed lines 30. The radiating elements 20 are arranged along the main line 10 and radiate radio waves. The feed lines 30 connect the main line 10 and the respective radiating elements 20. Moreover, the feed lines 30 are inserted into the respective radiating elements 20 by inserted lengths I so that an electrical coupling degree between one of the feed lines 30 and corresponding one of the radiating elements 20 is larger as the one feed line 30 is located closer to a leading end than a base end of the main line 10. Thus, it is possible to achieve a desired electric-power distribution ratio along with a simple antenna shape.

Furthermore, in the above-mentioned embodiment, the inserted length I of the feed line 30 is described to be a length (length of slit 21) along the insertion direction into the radiating element 20; however, not limited thereto. Another example of the inserted length I will be explained with reference to FIG. 9.

Figure 9:
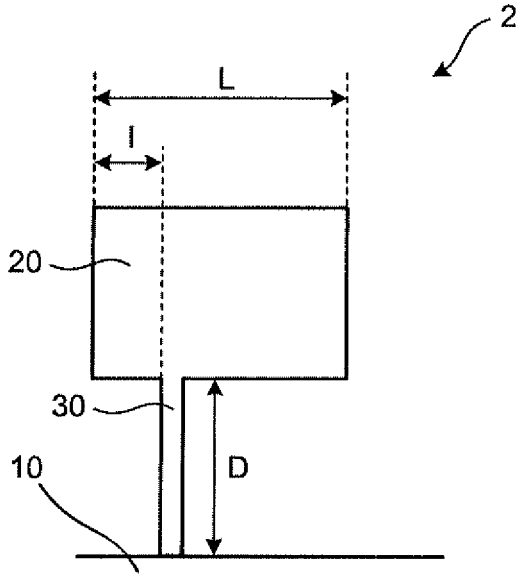
FIG. 9 is a diagram illustrating an antenna device according to a modification.

FIG. 9 is a diagram illustrating the antenna device 2 according to a modification. In FIG. 9, the element length L is defined as a length of the radiating elements 20 along a direction perpendicular to the insertion direction of the feed line 30. The inserted length I is defined by an inserted position of the feed line 30 with respect to the perpendicular direction.

Moreover, the feed-line length D is set to be any one of "¼λg×(2n+1)" and "¼λg×(2n)". The setting method of the inserted length I differs depending on whether the feed-line length D is "¼λg×(2n+1)" or "¼λg×(2n)".

In other words, when the feed-line length D is "¼λg×(2n+1)", the impedance gradually increases in a range of the ratio of the inserted length I from "0" to "0.5". In other words, the impedance value presents a tendency similar to that of the graph depicted in FIG. 3, furthermore, the values themselves are also similar to those of the graph depicted in FIG. 3.

Moreover, when the feed-line length D is "¼λg×(2n)", the impedance gradually decreases within a range of the ratio of the inserted length I from "0" to "0.5". In other words, the impedance value presents a tendency similar to that of the graph depicted in FIG. 6, furthermore, the values themselves are also similar to those of the graph depicted in FIG. 6.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An antenna device comprising:

a main line including (i) a base end to which electric power is supplied and (ii) a leading end;

a plurality of radiating elements that are arranged along the main line and radiate radio waves, the plurality of radiating elements being connected to the main line in parallel with each other; and a plurality of feed lines, each of which is branched from the main line to connect the main line and a corresponding radiating element of the radiating elements, wherein the feed lines are inserted into the respective radiating elements by inserted lengths so that an electrical coupling degree between one of the feed lines and corresponding one of the radiating elements is larger as the one feed line is located closer to the leading end than the base end of the main line.

2. The antenna device according to claim 1, wherein the inserted lengths of the feed lines are equal to or less than 50% of lengths of the respective radiating elements in insertion directions.

3. The antenna device according to claim 1, wherein when a guide wavelength of the main line is "λg" and line lengths of the feed lines are "¼λg×(2n+1)" ("n" is integer), the inserted length is shorter as the corresponding one feed line is located closer to the leading end of the main line.

4. The antenna device according to any one of claim 1, wherein when a guide wavelength of the main line is "λg" and line lengths of the feed lines are "¼λg×(2n)" ("n" is integer), the inserted length is longer as the corresponding one feed line is located closer to the leading end of the main line.

5. A radio-wave radiating method of an antenna device including a main line having (i) a base end to which electric power is supplied and (ii) a leading end; a plurality of radiating elements that are arranged along the main line and radiate radio waves, the plurality of radiating elements being connected to the main line in parallel with each other; and a plurality of feed lines, each of which is branched from the main line to connect the main line and a corresponding radiating element of the radiating elements, the method comprising:

inserting the feed lines into the respective radiating elements by inserted lengths so that an electrical coupling degree between one of the feed lines and a corresponding one of the radiating elements is larger as the one feed line is located closer to the leading end than the base end of the main line.

* * * * *